United States Patent [19]

Carena

[11] 4,072,833

[45] Feb. 7, 1978

[54] KEYBOARD SELECTOR SWITCH ASSEMBLY FOR A CALCULATING MACHINE

[75] Inventor: Ugo Carena, Ivrea (Turin), Italy

[73] Assignee: Ing. C. Olivetti & C., S.p.A., Ivrea (Turin), Italy

[21] Appl. No.: 679,407

[22] Filed: Apr. 22, 1976

[30] Foreign Application Priority Data

May 2, 1975 Italy ..... 68114/75

[51] Int. Cl.[2] ..... H01H 9/00; H01H 15/00

[52] U.S. Cl. ..... 200/5 R; 200/16 D

[58] Field of Search ..... 200/1 R, 5 R, 5 A, 16 R, 200/16 C, 16 D, 17 R, 291, 293–296

[56] References Cited

U.S. PATENT DOCUMENTS

| | | | |
|---|---|---|---|
| 2,453,498 | 11/1948 | Crowley | 200/16 D |
| 3,584,163 | 6/1971 | White | 200/291 X |
| 3,745,270 | 7/1973 | Granitz | 200/16 D |
| 3,800,107 | 3/1974 | Heide | 200/16 D |
| 3,934,101 | 1/1976 | Jones | 200/16 D X |

*Primary Examiner*—James R. Scott

*Attorney, Agent, or Firm*—Schuyler, Birch, Swindler, McKie & Beckett

[57] ABSTRACT

A selector for a keyboard of a calculating machine comprises a series of sliders for indicating information relevant to operations to be performed and a plurality of switches driven by the sliders for the entering of this information in the machine. The sliders are slidably mounted on a common support, in front of which there is mounted the support of a printed circuit. A series of movable contacts, carried by the sliders, are actuatable by the sliders to contact the fixed contacts for the input of the said information.

1 Claim, 7 Drawing Figures

KEYBOARD SELECTOR SWITCH ASSEMBLY FOR A CALCULATING MACHINE

BACKGROUND OF THE INVENTION

The present invention relates to a selector for a keyboard of a calculating, accounting or similar business machines comprising a series of sliders for indicating information relevant to a series of operations to be performed by the machine and a plurality of switches driven by the sliders for the entering of this information in the machine.

In keyboards of known calculating machines the selectors comprise single switches having more contacts which are individually mounted in the same keyboard. Both the switches and their assembly are rather costly, whereby the complete keyboard results expensive.

SUMMARY OF THE INVENTION

The main object of the present invention is to have a selector for a keyboard of a calculating machine which have relatively inexpensive components and which can easily be assembled.

The selector is particularly used in a keyboard comprising a cover having a plurality of aligned windows, and an input circuit; in particular the selector comprises a series of sliders and a common support aligned with the windows of the cover and slidably mounting the sliders so that they project from the window for indicating information relevant to operation to be performed by the machine. A printed circuit support is mounted in front of the common support parallel thereto, and supports a plurality of fixed contacts associated with the sliders and connected with the input circuit. The sliders drive movable contacts which selectively contact the fixed contacts for the entering of the information in the input circuit of the machine.

BRIEF DESCRIPTION OF THE DRAWING

A preferred embodiment is described by way of example in the following description with reference to the accompanying drawing in which.

DESCRIPTION OF THE PREFERRED EMBODIMENT

Figure 1:
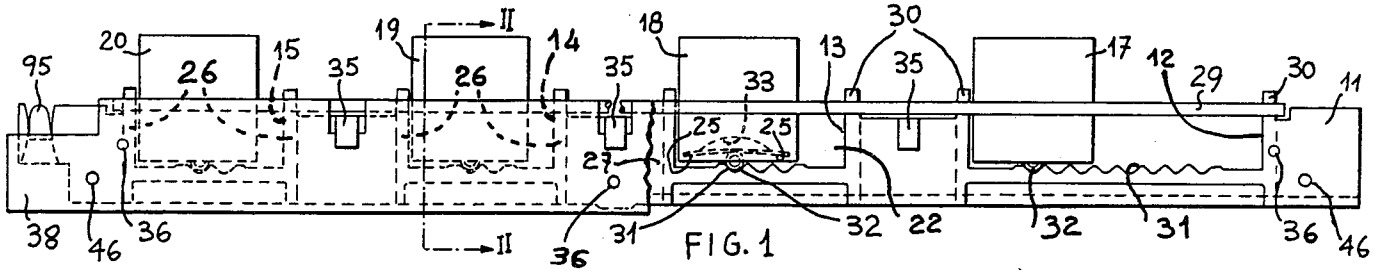
FIG. 1 is a front view of the selector switch assembly embodying the invention.

With reference to FIG. 1, the selector switch assembly comprises a plastic support 11 having an elongated form provided with a series of vanes 12, 13, 14 and 15 in which are slidably mounted corresponding sliders 17, 18, 19 and 20. The sliders have two U-shaped arms engaging slidably a vertical guide wall 22 of the vanes 12-15 of the support 11. On a first arm 23, the sliders 17-20 comprise an upper portion having an index 21 and on the second arm 24 comprise a series of sliding shoulders 28. The shoulders 28 engage slidably a rod 29 retained by projections 30 of the support 11 (FIG. 1) and which hold engaged the same sliders 17-20 vertically with respect to the wall 22.

Figure 2:
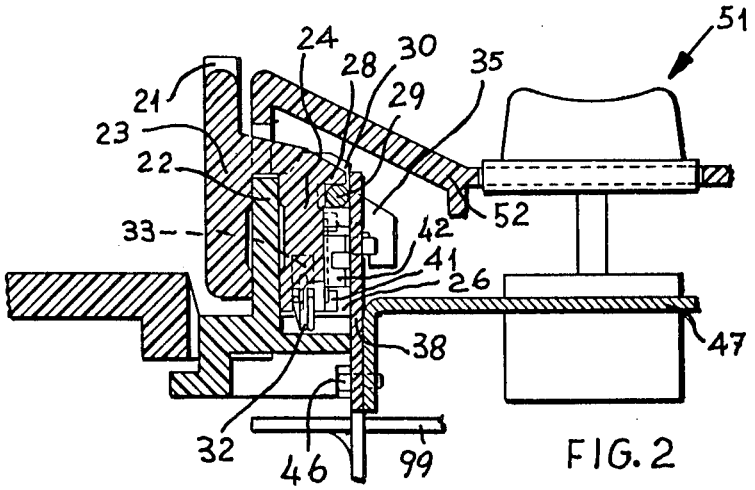
FIG. 2 is a section in accordance with the line II—II of FIG. 1.

The support 11, in correspondence of the lowest part of each vane 12-15, is provided with a series of positioning notches 31 which can receive the cylindrical portion of an elicoidal spring 32. The spring 32 comprises two flexible arms 25 partially located in a vertical notch 33 of the second arm 24 of each slider 17-20. Integral with each guide wall 22 are two transverse walls 26 joined to a support wall 27 which is parallel to the guide wall 22. The walls 22 are coplanar and the support walls 27 are equally spaced from the walls 22 by the transverse walls 26. Moreover the support 11 is provided in the support walls 27 with a series of hooked projections 35 and a series of studs 36 which engage, respectively, an edge and corresponding holes 34 of an insulated printed circuit support plate 38 (FIG. 2) located in front of the walls 22 parallely to the rod 29.

Figure 3:
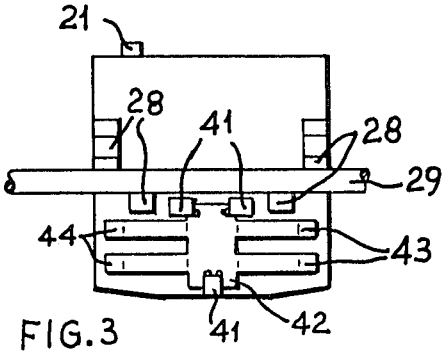
FIG. 3 is a detail of the assembly of FIG. 2.
Figure 5:
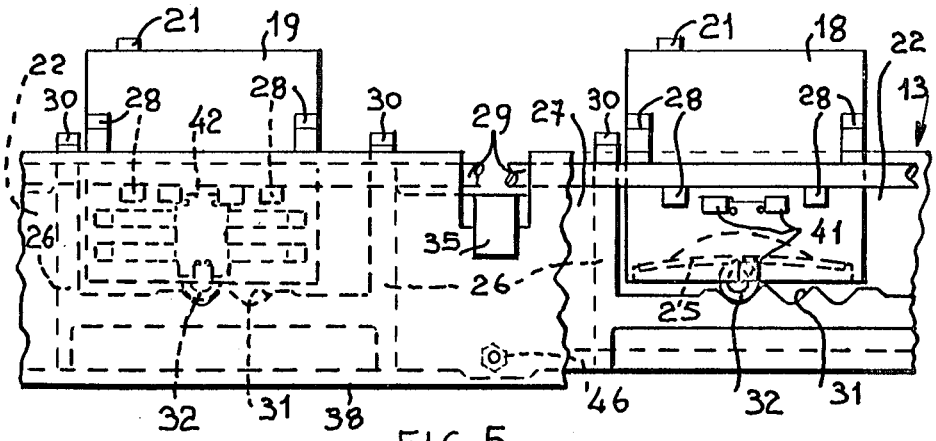
FIG. 5 is an enlarged partial view of the selector switch of FIG. 1.

The sliders 17-20, by the same side of shoulders 28, comprise three small hooks 41 (FIG. 3) which fix a leaf spring 42 provided by opposite sides with two pairs of bent and flexible parallel laminae carrying contacts 43, 44, respectively.

Figure 4:
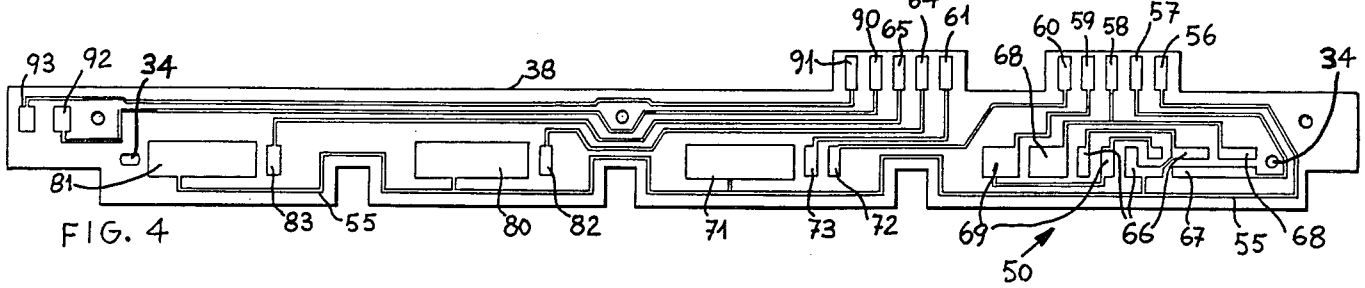
FIG. 4 is a front view of another details of the selector switch of FIG. 2.
Figure 7:
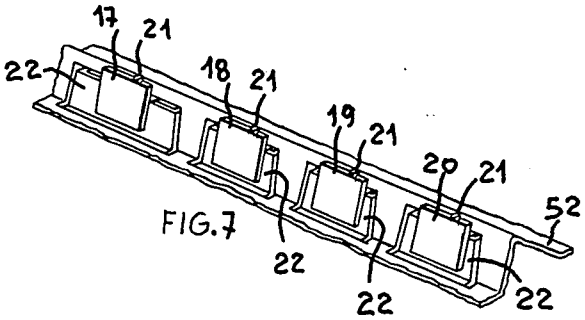
FIG. 7 is a prspective view of the selector of FIG. 1.

The contacts 43 and 44 can slide over conductive tracks, generally indicated with 50 in FIG. 4 and which are deposited in a manner known per se over the insulated support plate of the printed circuit 38.

The selector switch assembly is used in combination with a keyboard 51 of a calculating machine having a cover 52. For its mounting, the support 11 and the printed circuit 38 (FIG. 2) are held together through a series of screws 46 to a frame 47 of the keyboard 51, so that each index 21 is aligned with a corresponding graduated scale (not represented in the drawing) of the upper portion of the keyboard 51. The sliders 17-20 are in particular disposed along a vertical bent wall of the cover 52 of the machine projecting from corresponding windows of the same cover 52. The slider 17 is used for the setting of the number of decimals to be operated by the calculating machine. The notches 31 (FIG. 1), which are eight in number, indicated that the machine is functioning in "add-mode", with printing of 0 to 5 decimals and in the floating point, respectively.

The slider 18 is used to round off the last digits of a result and the notches 31 are three in number and indicate the functioning of the machine with rounding of the reslts to 0, 5, 9, respectively. The sliders 19-20 are used for totalizing or not the the reslts of products and to print or not the results of the operations.

The conductive tracks 50 of the support 38 is provided with a strip conductor 55, connected to a terminal 56, and with four areas associated to the sliders 17-20 and which are connected to a series of terminals 57, 58 and 59; 60; 61; 64 and 65, respectively. The terminal 56 is connected to a voltage source and, at least, to an island of the four areas through the conductor 55 and the other terminals are selectively electrically connectable to the terminal 56 through the connection between the other islands affected by sliders 17-20.

Figure 6:
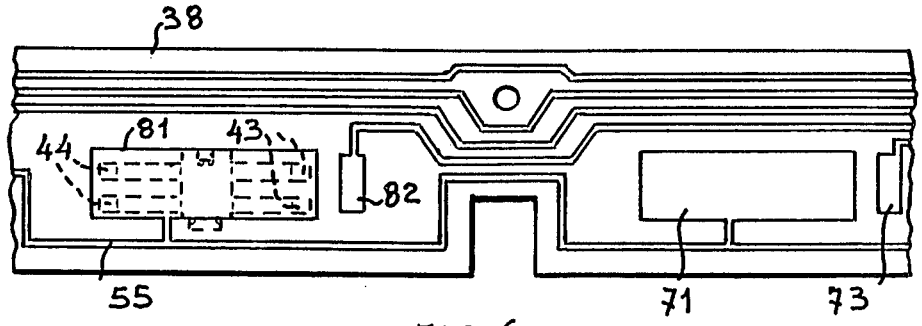
FIG. 6 is an enlarged partial view of the detail of FIG. 4.

The area associated with the slider 17 is provided with three conductive islands 66 which are connected to the conductor 55 and which partially occupy two tracks of the printed circuit. The area is also provided with three islands 67, 68 and 69 connected to the terminal 57, 58 and 59, respectively. The islands 66-69 can be connected in a coded manner to the terminal 56 by the movable contacts 43 and 44 of the leaf spring 42 so that to each one of the eight positions of the slider 17 corresponds a different combination of voltages in the terminals 57–59. In particular, starting from the left side in FIG. 4, contacts 43 and 44 (indicated in dotted line in FIG. 6) of sider 17 put in tension successively the islands 69; no island; 68; 69 and 68; 67; 69 and 67; 68 and 67; and 69, 68 and 67.

The area associated with the slider 18 comprises an island 71 connected to the conductor 55 and over which side the contacts 44 of the spring 42 and two islands 72, 73 over which can slide the contacts 43 of the spring 42. The islands 72 and 73 are connected to the terminals 60, 61 so that the information associated with the three positions of the slider 18 can be entered, in coded form, in the machine.

Each area associated with the slider 19, 20 is provided with a corresponding island 80, 81, respectively, which is connected to the conductor 55 and over which slide the pair of contacts 44 and an island 82, 83, respectively, on which can slide the pair of contacts 43 and which are connected to the corresponding terminal 64 and 65.

The support 38 is also provided with two other terminals 90, 91 connected to two areas 92 and 93 over which bear corresponding contacts of a light 95 (FIG. 1) carried by the support 11.

For the mounting of the selector on the keyboard 51 there are inserted the springs 32 in the notches 33 (FIG. 1) of the slider 17–20 and the leaf springs 42 (FIG. 4) among the hooks 41. The sliders 17–20 are successively located in the vanes 12, 15 of the support 11 to embrace the walls 22. There is engaged the rod 29 among the shoulders 30 of a support 11 and the plate 38 of the printed circuit. The hooked projections 35 hold engaged the studs 36 of the support 11 in the corresponding holes 34 of the plate 38, maintaining the plate 38 into contact with the support walls 27 and the rod 29 blocked against the projections 30. The support 11 and the printed circuit 38 are then fixed to the frame 47 through the screws 46. At the end, the terminals of the printed circuit 38 are connected in a manner known per se to corresponding terminals of the input circuit of the machine, generally indicated with 99 in FIG. 2.

It is to be noted that the sliders 17–20 are snapped from one position to the other through the elastic action of the spring 32 over the notches 31, positioning the sliders 17–20 on selected fixed positions along the vanes 12–15, and the contacts 43 and 44 of the leaf spring 42 perform the codification of the information for each position of the sliders hereinbefore described.

What I claim is:

1. A selector switch assembly for a keyboard of calculating, account and similar machines of the type having a frame mounting the keyboard and a cover, wherein the cover is provided with a first wall from which project the keys of the keyboard and a second wall substantially perpendicular to said first wall and comprising a plurality of aligned windows; the selector switch assembly comprising:

a plurality of sliders, each said slider comprising a pair of U-shaped arms, one of said pair of arms comprising first and second shoulder means;

a common support including a plurality of spaced coplanar guide walls for guiding the U-shaped arms of said sliders, a series of support walls, and transverse walls connecting said support walls with said guide walls for holding said guide walls displaced from said support walls along a plane parallel to said guide walls, said support walls having notches and hook members thereon;

a rod member fixedly mounted in the notches of said transverse walls and engaged with the first shoulder means of said sliders for holding said sliders in slidable engagement with said guide walls;

a printed circuit support plate engaged by the hook members of said support walls so that said printed circuit support plate bears against said support walls, said printed circuit support board bearing against said rod member to hold said rod member engaged with the notches of said transverse walls, said printed circuit support plate including a plurality of areas associated with said sliders and each including conductive tracks;

a plurality of conductive laminae each engaged by the second shoulder means of each slider and slidable over the conductive track of the associated area; and means for fixing said assembly to the frame of the machine so that said guide walls are substantially parallel with said second wall of said cover and aligned with said windows, so that said sliders project from said windows.

* * * * *